US005861843A

United States Patent [19]

Sorace et al.

[11] Patent Number: 5,861,843

[45] Date of Patent: Jan. 19, 1999

[54] PHASE ARRAY CALIBRATION ORTHOGONAL PHASE SEQUENCE

[75] Inventors: Ronald E. Sorace, Torrance; Victor S. Reinhardt, Rancho Palos Verdes; Clinton Chan, Chino Hills, all of Calif.

[73] Assignee: Hughes Electronics Corporation, El Segundo, Calif.

[21] Appl. No.: 997,078

[22] Filed: Dec. 23, 1997

[51] Int. Cl.[6] ..... H01Q 3/24

[52] U.S. Cl. ..... 342/372; 342/174; 342/373; 342/374

[58] Field of Search ..... 342/174, 372, 342/373, 374

[56] References Cited

U.S. PATENT DOCUMENTS 5,063,529 11/1991 Chapoton ..... 364/571.02
5,248,982 9/1993 Reinhardt ..... 342/375
5,455,592 10/1995 Huddle ..... 342/359
5,530,445 6/1996 Wachs et al. ..... 342/174
5,677,696 10/1997 Silverstein et al. ..... 342/360

*Primary Examiner*—Thomas Tarcza
*Assistant Examiner*—Dao L. Phan
*Attorney, Agent, or Firm*—Georgann S. Grunebach; M. W. Sales

[57] ABSTRACT

Methods and systems for calibrating an array antenna are described. The array antenna has a plurality of antenna elements each having a signal with a phase and an amplitude forming an array antenna signal. For calibration, the phase of each element signal is sequentially switched one at a time through four orthogonal phase states. At each orthogonal phase state, the power of the array antenna signal is measured. A phase and an amplitude error for each of the element signals is determined based on the power of the array antenna signal at each of the four orthogonal phase states. The phase and amplitude of each of the element signals is then adjusted by the corresponding phase and amplitude errors.

20 Claims, 4 Drawing Sheets

PHASE ARRAY CALIBRATION ORTHOGONAL PHASE SEQUENCE

GOVERNMENT RIGHTS

The present invention was made with Government support under contract number [Secret Classification] awarded by the National Aeronautics and Space Administration "NASA." The Government has certain rights in the present invention.

TECHNICAL FIELD

The present invention relates generally to phased array antennas and, more particularly, to a method of calibrating a phased array antenna.

BACKGROUND ART

An array antenna includes an array of antenna elements for transmission or reception of electromagnetic signals. The antenna elements are fed with one or more signals whose amplitudes and phases are determined to form a beam, i.e., an array antenna signal in a specified direction. Typically, the relative amplitudes of each element signal are fixed by attenuators set at appropriate levels to shape the beam, while phase shifters connected to the elements are adjusted for changing the phases of the signals to steer the beam.

To precisely control the beam, the actual phase response of each phase shifter must be known. However, phase response of a phase shifter is subject to unavoidable errors and variations due to manufacturing discrepancies and to various changes occurring as a function of time and temperature. Thus, calibration is required to provide phase correction for each phase shifter. The phase calibration data can be stored and used during steering operations to correct phase response errors.

The amplitudes of the signals fed to the elements are adjusted with attenuators connected to the elements. The attenuators are also subject to errors and variations. Thus, calibration is required to provide attenuator calibration data for each attenuator. The attenuator calibration data can be stored and used during steering operations to correct attenuator response errors.

Previous methods of phased array calibration have relied on scanning each element of the array through all of its phase values relative to the other elements and measuring the power of the array antenna signal at each phase value. The measured phase value corresponding to maximum power is compared to the ideal phase value. The ideal phase value is the phase value corresponding to maximum power when there are no phase errors or variations. Thus, the difference between the measured phase value corresponding to maximum power and the ideal phase value is the phase error, or phase offset, for that element.

This procedure is repeated at least once for each element of the array. After the phase offsets for each element have been determined, the phases of the element signals are changed by their respective phase offsets to effect the calibration. Consequently, the errors are, at least currently, taken into account.

A problem with scanning each element through all of its phase values is that this requires a large number of measurements. For instance, phase values fall within the range of 0° to 360°. Thus, if the phase settings for each element were quantized in increments of 1°, then three hundred and sixty phase values must be scanned. If the array has a large number of elements, for example, one hundred, then at least three thousand six hundred measurements must be made for calibration of the array, and iteration may be required to improve accuracy. Scanning each element through all of its phase values is suboptimal in a noisy environment and has the disadvantage of potentially large interruptions to service.

Accordingly, a need has developed for a quicker and more efficient method which requires fewer measurements for calibrating an array antenna.

SUMMARY OF THE INVENTION

It is an object of the present invention to provide an orthogonal phase calibration method for an array antenna.

It is another object of the present invention to provide a calibration method for an array antenna which determines phase errors based on power measurements made at orthogonal phase states.

It is a further object of the present invention to provide a calibration method for an array antenna which determines amplitude errors based on power measurements made at orthogonal phase states.

In carrying out the above objects and other objects, a method of calibrating an array antenna element having a signal with a phase and an amplitude is provided. The method includes sequentially switching the phase of the antenna element signal through four orthogonal phase states. At each of the four orthogonal phase states, the power of the array antenna signal is measured. A phase error for the antenna element signal is determined as a function of the power of the array antenna signal at each of the four orthogonal phase states. The phase of the antenna element signal is then adjusted by the phase error.

Further, in carrying out the above objects and other objects, a method for calibrating an array antenna provided with a plurality of antenna elements each having a signal with a phase and an amplitude forming an array antenna signal is provided. The method includes sequentially switching the phase of each antenna element signal one at a time through four orthogonal phase states. At each orthogonal phase state the power of the array antenna signal is measured. A phase error for each of the antenna element signals is then determined. The phase error for an antenna element signal is a function of the power of the array antenna signal at each of the four orthogonal phase states. The phase of each of the antenna element signals is then adjusted by the corresponding phase error.

Still further, in carrying out the above objects and other objects, the present invention provides an array antenna system. The array antenna system includes an array antenna provided with a plurality of antenna elements each having a signal with a phase and an amplitude forming an array antenna signal. A calibration processor is operable with the array antenna to sequentially switch the phase of each antenna element signal one at a time through four orthogonal phase states and measure at each orthogonal phase state the power of the array antenna signal. The calibration processor is further operable to determine a phase error for each of the antenna element signals. The phase error for an antenna element signal is a function of the power of the array antenna signal at each of the four orthogonal phase states. The calibration processor is further operable to adjust the phase of each of the antenna element signals by the corresponding phase error.

The provided methods and system of the present invention further determine an amplitude error for an antenna element signal as a function of the power of the array antenna signal at each of the four orthogonal phase states.

The amplitude of the antenna element signal can then be adjusted by the amplitude error.

The advantages accruing to the present invention are numerous. The present invention circumvents the need for scanning each element through all phase states in search of extrema. The use of four phase settings as opposed to scanning all possible phase states reduces the time required for calibration and, hence, the potential impact on an array antenna system. The measurement of power at four orthogonal phase states provides adequate information for a maximum likelihood estimate of errors. Such an estimate is optimal in an adverse environment.

These and other features, aspects, and embodiments of the present invention will become better understood with regard to the following description, appended claims, and accompanying drawings.

BEST MODES FOR CARRYING OUT THE INVENTION

Figure 1:
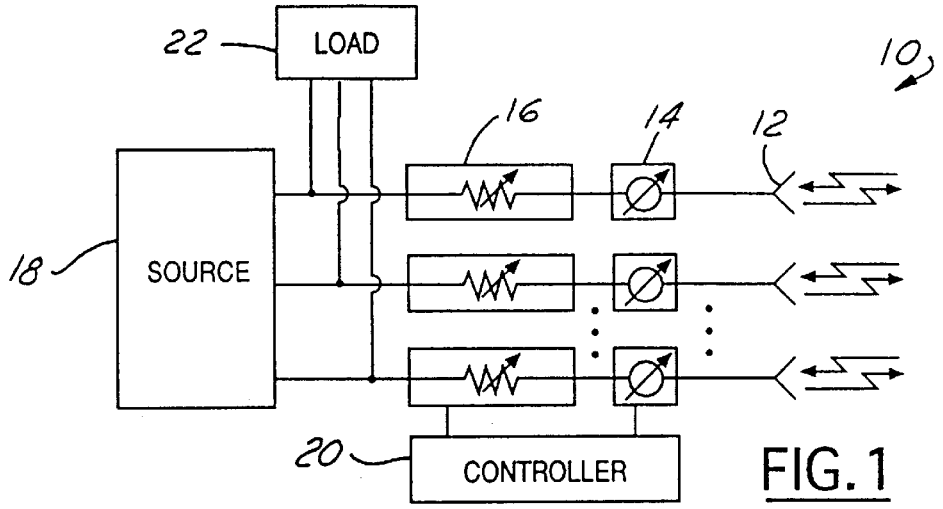
FIG. 1 is a schematic block diagram of an array antenna for use with the present invention.

Referring now to FIG. 1, an illustrative phased array antenna 10 is shown. Phased array antenna 10 includes a plurality of antenna elements 12. Each antenna element 12 is coupled to a corresponding phase shifter 14 and a corresponding attenuator 16. Each antenna element 12 may transmit and receive electromagnetic signals such as radio frequency (RF) signals.

In the transmit mode, a power source 18 feeds signals through respective attenuators 16 and phase shifters 14 to each antenna element 12 for transmission of an array antenna signal. Power source 18 may include a splitter (not specifically shown) for splitting a single signal into the signals fed to antenna elements 12. A controller 20 is operable with each of phase shifters 14 and attenuators 16 to change the phases and the amplitudes of the signals fed to antenna elements 12. Controller 20 sets the phases and the amplitudes of the signals to form a transmission beam having a given radiation pattern in a specified direction. Controller 20 then changes the phases and the amplitudes to steer the beam, form a different beam, or the like. Typically, each of attenuators 16 are set approximately at a common level such that each of antenna elements 12 are driven by power source 18 equally. However, these levels may be varied for beam shaping.

In the receive mode, antenna elements 12 provide signals received from an external source through respective phase shifters 14 and attenuators 16 to power load 22. Power load 22 may include a combiner (not specifically shown) for combining the received signals into a single signal. Controller 20 is operable with phase shifters 14 and attenuators 16 to change the phase and the amplitude of the signals received by antenna elements 12. Controller 20 sets the phases and the amplitudes to form a reception pattern in a specified direction. Controller 20 then changes the phases and the amplitudes to steer the reception pattern, form a different reception pattern, or the like. Typically, each of attenuators 16 are set approximately at a common level such that each of antenna elements 12 feed power load 22 equally. However, these levels may also be varied for beam shaping.

Figure 2:
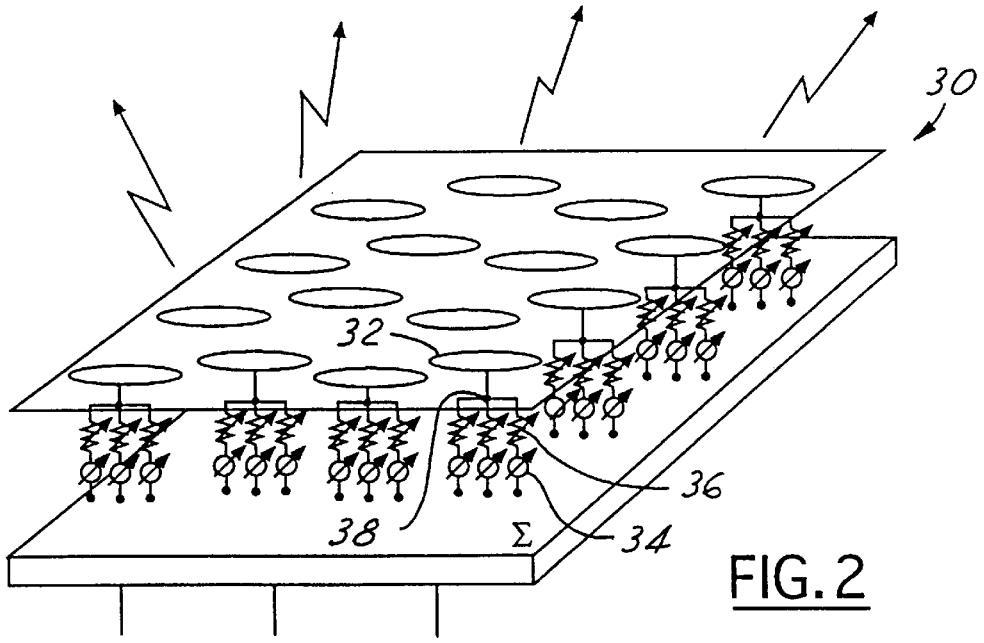
FIG. 2 is a diagram of a multiple beam array antenna for use with the present invention.

Referring now to FIG. 2, an illustrative phased array antenna 30 is shown. Phased array antenna 30 has a plurality of antenna elements 32 arranged in a M×N array. Each antenna element 32 is coupled to a plurality of phase shifters 34 and a plurality of attenuators 36. Each phase shifter 34 is arranged in series with a respective attenuator 36. Each serially arranged phase shifter 34 and attenuator 36 pair is arranged in parallel with two other serially arranged phase shifters and attenuators. All of the pairs of phase shifters 34 and attenuators 36 are connected at one end 38 to a respective antenna element 32.

Antenna elements 32 are fed with or receive one or more signals whose phases and amplitudes are determined to form a beam in a specific direction. In FIG. 2, as an example, three signals are fed to or received from each antenna element 32. The signal fed to each antenna element 32 is the sum of three signals with phase shifting and attenuation dictated by the desired direction of the beam for each of the radiated signals. Thus, phased array antenna 30 may have three different beams. The signal received by each antenna element 32 is divided into three signals with each signal phase shifted and attenuated as desired.

Because accurate pointing of a beam of a phased array antenna demands precise control of phase and amplitude, exact knowledge of the phase and gain response of the phase shifting and attenuator electronics is essential. However, as stated in the Background Art, the parameters of the phase shifting and attenuator electronics vary with temperature and drift with time. Thus, periodic calibration of the phased array antenna is necessary to ascertain phase and amplitude corrections for each antenna element.

Figure 3:
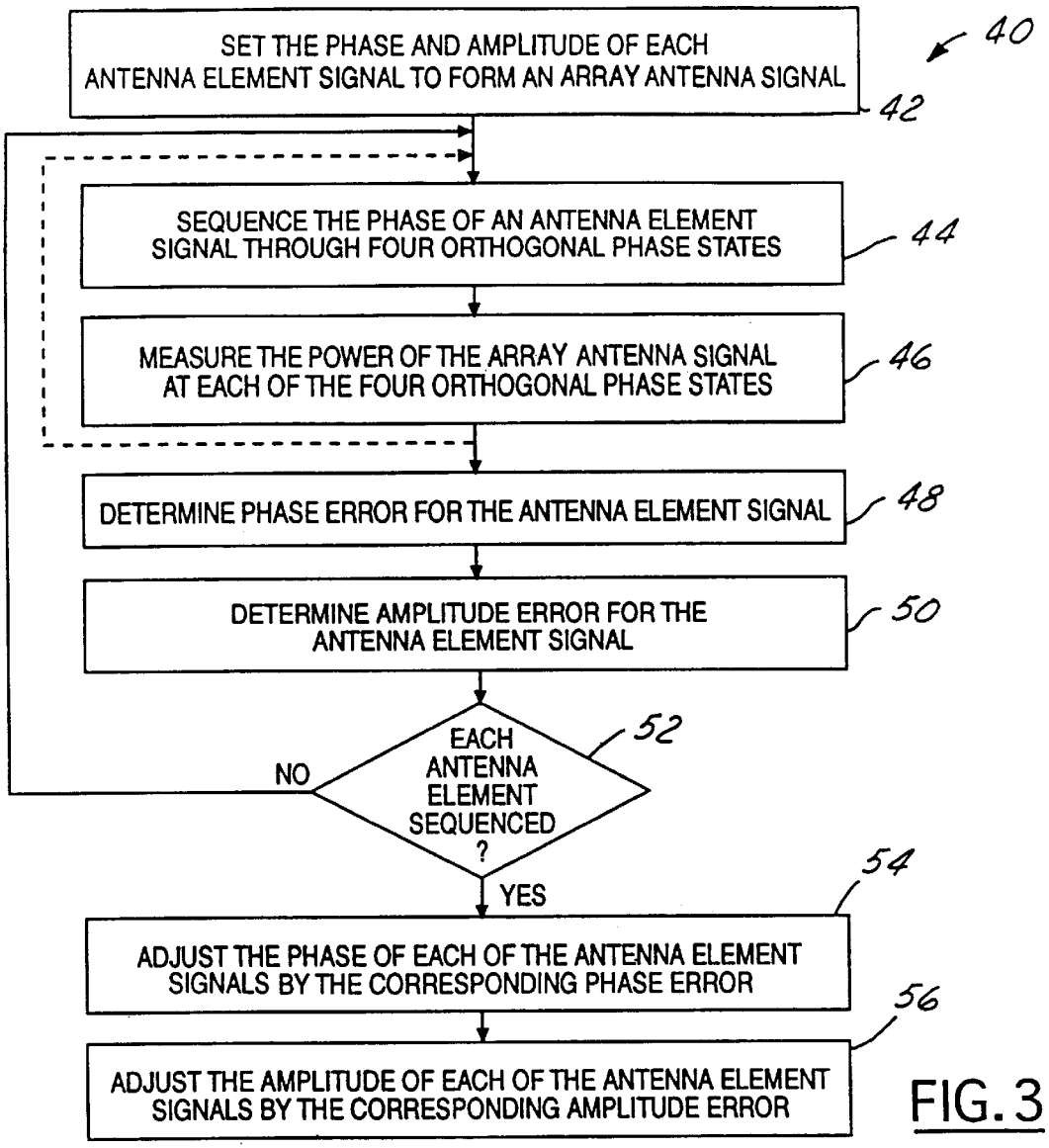
FIG. 3 is a flowchart representing operation of an array antenna calibration method according to the present invention.

Referring now to FIG. 3, a flowchart 40 illustrates the procedure of the present invention for calibrating a phased array antenna such as array antenna 10 having a plurality of antenna elements. Each of the antenna elements have a signal with a phase and an amplitude. The antenna element signals form an array antenna signal. Flowchart 40 begins with block 42 setting the phase and amplitude of each antenna element signal to form a test beam. The phase values of the antenna element signals are typically different. However, regardless of the actual phase value, the phase values of each of the antenna element signals for the test beam position are regarded as the 0° phase state. In the test beam position, the 0° phase state is the reference or nominal phase state.

The amplitudes of the antenna element signals are typically the same. Thus, the attenuators connected to the antenna elements are set approximately at a common level.

Subsequently, block 44 sequences the phase of one antenna element signal through four orthogonal phase states. The four orthogonal phase states consist of the reference phase state (0°) and the phase states corresponding to 180°, 90°, and 270° relative to the reference phase state. The phases and amplitudes of all the other antenna element signals remain constant while the phase of the one antenna element signal is being sequenced.

At each of the four orthogonal phase states (0°, 90°, 180°, and 270°) block 46 measures the power of the array antenna signal. The power measurements $P_0$, $P_{180}$, $P_{90}$, and $P_{270}$ correspond to phase states $\phi_0$, $\phi_{180}$, $\phi_{90}$, and $\phi_{270}$. Block 48 then determines a phase error for the antenna element signal based on the power measurements made by block 46. Block 50 then determines an amplitude error for the antenna element signal based on the power measurements made by block 46. Blocks 44 and 46 can be repeated as indicated by the dotted line to integrate multiple measurements of received power and improve the signal-to-noise ratio of the measurement.

Decision block 52 then determines whether each of the antenna elements have had their phases sequenced through four orthogonal phase states. If not, then the process repeats with block 44 sequencing the phase of a different antenna element signal so that the phase and amplitude errors for the different antenna element signal can be determined.

After the phase and amplitude errors for all of the antenna element signals have been determined, block 54 adjusts the phase of each of the antenna element signals by the corresponding phase error. Block 56 then adjusts the amplitude of each of the antenna element signals by the corresponding amplitude error. The above procedure may be repeated until the phase and amplitude calibration errors converge within an acceptable level.

Figure 4:
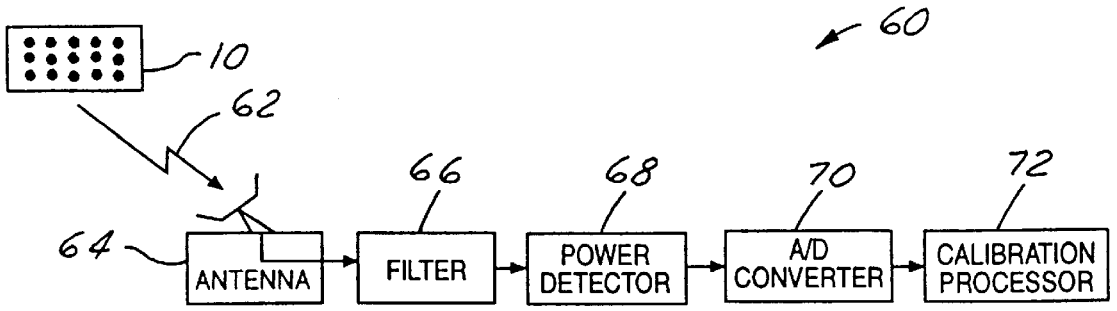
FIG. 4 is a block diagram of an array antenna signal power measurement system for use with the calibration method of the present invention.

Referring now to FIG. 4, a measurement system 60 for measuring power of a calibration signal 62 received by a receiving antenna terminal 64 is shown. Array antenna 10, which is on a satellite in the example shown, transmits calibration signal 62 to terminal 64 for calibration. Note that pointing a beam at a fixed station (terminal 64) assumes that dependence of calibration on direction is negligible. If parameters are sensitive to pointing direction, then an alternative such as multiple receiving stations must be implemented.

As described with reference to FIG. 3, calibration signal 62 includes a sequence of phase transitions $\phi_0$, $\phi_{180}$, $\phi_{90}$, and $\phi_{270}$ with array antenna signal power measurements $P_0$, $P_{180}$, $P_{90}$, and $P_{270}$, performed in each state. Measurement system 60 consists of terminal 64, and a narrowband filter 66 followed by a power detector 68. Power detector 68 is preferably a quadratic detector. The input to power detector 68 is an RF signal having an RF power. The output from power detector 68 is a voltage proportional to the RF power.

An analog-to-digital (A/D) converter 70 follows power detector 68. A/D converter 70 converts the output analog voltage from power detector 68 into a digital signal for receipt by a calibration processor 72. Calibration processor 72 processes the digital signal to determine the phase and amplitude error and correction.

Calibration processor 72 determines the correction data according to the following derivations. It is assumed that all of the antenna elements of array antenna 10 are driven approximately equally.

The received voltage at the input to power detector 68 when all of antenna elements 12 of array antenna 10 have been set to their reference phase values is:

$$r(t) = \sum_{m-1}^{M} a_m \cos(\omega t + \delta_m) + n(t) \tag{1}$$

where, $\omega$ is the transmitted frequency, $\delta_m$ is the phase offset of the $m^{th}$ element relative to its nominal value, $a_m$ is the RF voltage from the $m^{th}$ element, and n(t) is narrowband thermal noise which is uncorrelated between samples.

The narrowband noise is:

$$n(t)=n_c(t)\cos \omega t-n_s(t)\sin \omega t$$

where $n_c(t)$ and $n_s(t)$ are the inphase and quadrature components, respectively. These components are independent and identically distributed Gaussian processes having zero mean and variance $\sigma^2=N_0B$ with $N_0/2$ the noise power density and 2B the bandwidth of the filter.

Introducing a phase of $\theta$ on the $k^{th}$ element yields:

$$r(t) = \sum_{\substack{m-1 \\ m\neq k}}^{M} a_m \cos(\omega t + \delta_m) + a_k \cos(\omega t + \theta + \delta_k) + n(t) = \left[\sum_{\substack{m-1 \\ m\neq k}}^{M} a_m \cos\delta_m + a_k \cos(\theta + \delta_k) + n_c(t)\right] \cos\omega t - \left[\sum_{\substack{m-1 \\ m\neq k}}^{M} a_m \sin\delta_m + a_k \sin(\theta + \delta_k) + n_s(t)\right] \sin\omega t \tag{2}$$

at the input to power detector 68. The output from power detector 68 is the square of the envelope of its input:

$$q=(A_c+v_c+n_c)^2+(A_s+v_s+n_s)^2 \tag{3}$$

where, $$A_c = \sum_{\substack{m-1 \\ m\neq k}}^{M} a_m \cos\delta_m,\ A_s = \sum_{\substack{m-1 \\ m\neq k}}^{M} a_m \sin\delta_m,$$

$$v_c = a_k \cos(\theta + \delta_k),\ \text{and}\ v_s = a_k \sin(\theta + \delta_k).$$

The output of power detector 68 is sampled at a time interval $T_s$>>1/B so that the samples are uncorrelated. The sampled output of power detector 68 is:

$$q_t=(A_c+v_c+n_{ct})^2+(A_s+v_s+n_{st})^2 \tag{4}$$

where, $n_{ct}$ and $n_{st}$ are Gaussian variables as described previously.

For each antenna element, the statistic $q_t$ is a non-central chi-squared random variable with two degrees of freedom and density:

$$p(q_l) = (2\sigma^2)^{-1}\exp[-(q_l + \lambda)/2\sigma^2] I_0\left(\frac{\sqrt{q_l\lambda}}{\sigma^2}\right) \tag{5}$$

$I_0(\cdot)$ in Equation (5) denotes the modified Bessel function of the first kind of zero order. The non-central parameter ($\lambda$) is:

$$\lambda=(A_c+v_c)^2+(A_s+v_s)^2. \tag{6}$$

The mean ($\mu$) and variance ($\sigma_q^2$) of the statistic $q_t$ are:

$$\mu=E\{q_t\}=\lambda+2\sigma^2 \tag{7}$$

and $$\sigma_q^2=\mathrm{Var}\{q_t\}=4\sigma^2\lambda+4\sigma^4 \tag{8}$$

Assume that L samples of the output of the power detector are averaged to form the statistic:

$$\bar{q}=\frac{1}{L}\sum_{l=1}^{L} q_l \tag{9}$$

with the samples $q_t$ of q being independent. The statistic $\bar{q}$ is a non-central chi-squared random variable having 2L degrees of freedom with non-central parameter:

$$\bar{\lambda}=\frac{1}{L}\sum_{l=1}^{L}[(A_c+v_c)^2+(A_s+v_s)^2]=\lambda, \tag{10}$$

a density:

$$p(\bar{q})=\left(\frac{2\sigma^2}{L}\right)^{-1}\left(\frac{\bar{q}}{\lambda}\right)^{\frac{L-1}{2}}\exp\left[-\frac{\bar{q}+\lambda}{2\sigma^2/L}\right]I_{L-1}\left(\frac{\sqrt{q\lambda}}{\sigma^2/L}\right), \tag{11}$$

a mean:

$$\bar{\mu}=E\{\bar{q}\}=\mu=E\{q\}=\lambda+2\sigma^2, \tag{12}$$

and a variance:

$$\bar{\sigma}^2=\mathrm{Var}\{\bar{q}\}=(4\sigma^2\lambda+4\sigma^4)/L. \tag{13}$$

The statistic $\bar{q}$ is an unbiased estimate of $\mu$ since $$E\{\bar{q}\}=\frac{1}{L}\sum_{l=1}^{L}E\{q_l\}-E\{q\}=\lambda+2\sigma^2, \tag{14}$$

and it is asymptotically efficient. Since the chi-squared distribution is approximately Gaussian about the mean for large degrees of freedom, the intuitive tendency is to chose maximum likelihood estimates for the phase variation $\delta_k$ and the amplitude variation $a_k$. One may solve the gradient of the likelihood function (11) for maxima. However, these estimates evolve naturally from consideration of the differences $q_{270}-q_{90}$ and $q_0-q_{180}$ which are unbiased estimates:

$$E\{q_{270}-q_{90}\}=4a_k(A_c\sin\delta_k-A_s\cos\delta_k) \tag{15}$$

and $$E\{q_0-q_{180}\}=4a_k(A_c\cos\delta_k+A_s\sin\delta_k). \tag{16}$$

Note that the element index k is understood for the statistics $\bar{q}$, and the array antenna signal power is measured for each phase setting of each element. Since only the phase of the $k^{th}$ element is varying, the sum of the other element voltages forms the reference, i.e., $A_s\cong 0$ (assuming $\delta_m$ is small so that $A_c>>A_s$), which gives:

$$\bar{q}_{270}-\bar{q}_{90}\cong 4a_kA_c\sin\delta_k \tag{17}$$

and $$\bar{q}_0-\bar{q}_{180}\cong 4a_kA_c\cos\delta_k. \tag{18}$$

Hence, the estimates of the phase $\hat{\delta}_k$ and amplitude $\hat{a}_k$ variations become:

$$\hat{\delta}_k=\tan^{-1}\left[\left(\frac{\bar{q}_{270}-\bar{q}_{90}}{\bar{q}_0-\bar{q}_{180}}\right]\right) \tag{19}$$

and $$\hat{a}_k=\frac{\sqrt{(\bar{q}_{270}-\bar{q}_{90})^2+(\bar{q}_0-\bar{q}_{180})^2}}{4A_c} \tag{20}$$

The deviations of these estimates are readily derived from first order differentials:

$$\hat{\sigma}_\delta^2=\mathrm{Var}\{\hat{\delta}_k\}\cong\sum_\theta\left(\frac{\partial\hat{\delta}_k}{\partial\bar{q}_\theta}\right)^2\sigma_\theta^2=\frac{\sigma^2/L}{2a_k^2A_c^2}(\sigma^2+A_c^2+A_s^2+a_k^2) \tag{21}$$

and $$\hat{\sigma}_a^2=\mathrm{Var}\{\hat{a}_k\}\cong\sum_\theta\left(\frac{\partial\hat{a}_k}{\partial\bar{q}_\theta}\right)^2\sigma_\theta^2=\frac{\sigma^2/L}{2A_c^2}(\sigma^2+A_c^2+A_s^2+a_k^2). \tag{22}$$

Since the elements are driven approximately equally, $a_m\cong a_k$ for all m and $A_c\cong=(M-1)a_k$. Using approximation $A_s\cong 0$ gives the errors:

$$\hat{\sigma}_\delta^2\cong\frac{N_0B}{4LP_k}\left[1+\frac{N_0B}{2P_k(M-1)^2}\right] \tag{23}$$

and $$\hat{\sigma}_a^2\cong\frac{N_0B}{2L}\left[1+\frac{N_0B}{2P_k(M-1)^2}\right]$$

where, $P_k=a_k^2/2$ denotes the power of the $k^{th}$ element.

Figure 5:
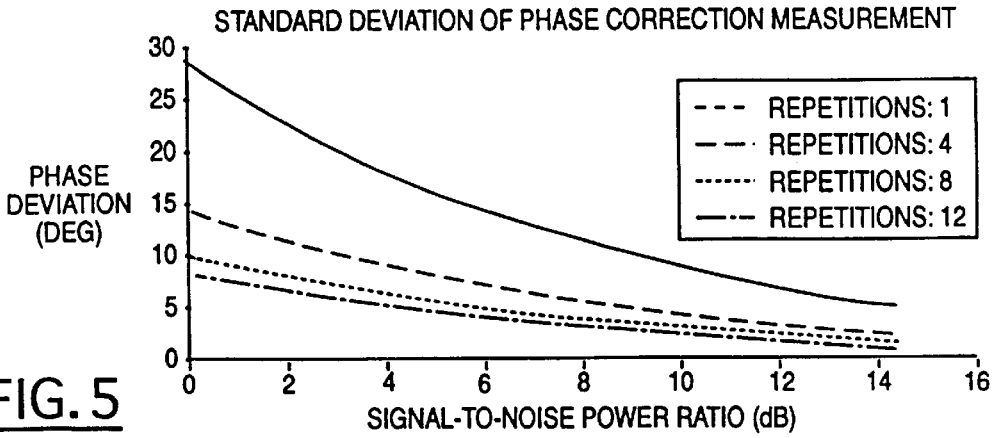
FIG. 5 is a graph of the standard deviation of phase correction.
Figure 6A:
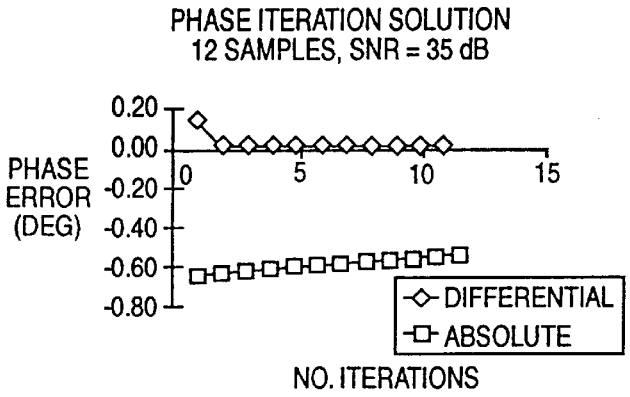
FIGS. 6(*a–d*) illustrate the convergence of an estimation process of the calibration method of the present invention.
Figure 6B:
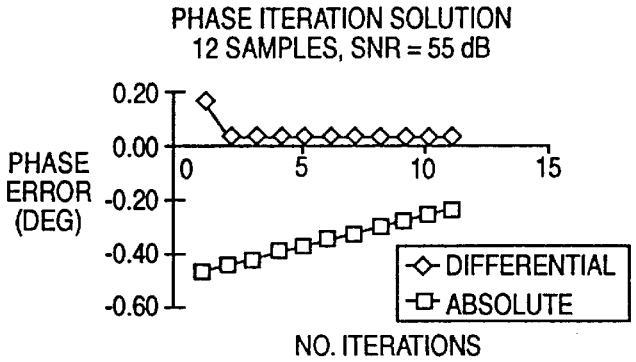
Figure 6C:
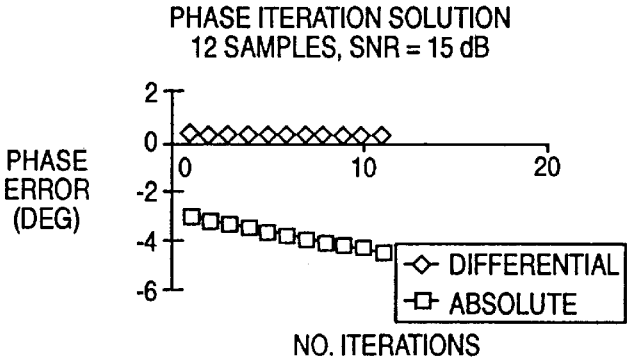
Figure 6D:
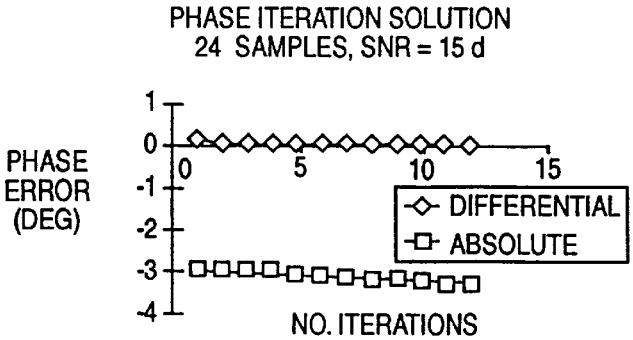

The deviation of the phase error estimate $\hat{\sigma}_\delta$ from (23) is plotted in FIG. 5 and indicates that an accuracy of 2° requires approximately twelve iterations at a signal-to-noise power ratio of approximately 13 dB per element.

Because the residual phases of all elements other than the $k^{th}$ element were disregarded in (17) and (18) and the subsequent analysis, the estimates of $\delta_k$ and $a_k$ are relative to the aggregate of the other elements. Note that this reference varies depending on which element is being tested. Hence, caution must be exercised to update the element corrections only after calibration of the entire array.

The derivation of the phase and amplitude estimators in (19) and (20) assumes perfect amplitude and phase control of the element signal. The inphase and quadrature components of this signal were denoted by $v_c(\theta)$ and $v_s(\theta)$ following (3). Actual phase shifters are unlikely to give exact phase settings of 0°, 90°, 180°, and 270°, and real attenuators may not permit exact control of the amplitude $a_k$. However, errors in the settings are deterministic and may be measured. Denote the phase settings of the $k^{th}$ element by $\theta_m=m\pi/2$, m=0,1,2,3 with corresponding signal components $v_c=a_{km}\cos(\theta_m+\xi_{km}+\delta_k)$ and $v_s=a_{km}\sin(\theta_m+\xi_{km}+\delta_k)$ having amplitudes $a_{km}$ and phase offsets $\xi_{km}$ which contain imperfections and amplitude errors. Following the same rationale which led to (17) and (18) gives:

$$E\{q_m-q_n\}=a_{km}^2-a_{kn}^2+2A_c[a_{km}\cos(\theta_m+\xi_{km}+\delta_k)-a_{kn}\cos(\theta_n+\xi_{kn}+\delta_k)]$$
$$+2A_s[a_{km}\sin(\theta_m+\xi_{km}+\delta_k)-a_{kn}\sin(\theta_n+\xi_{kn}+\delta_k)] \quad (24)$$

where, $$A_c=\sum_{\substack{l=1\\ l\neq k}}^{M} a_{l,0}\cos(\xi_{l,0}+\delta_l)$$

and $$A_s=\sum_{\substack{l=1\\ l\neq k}}^{M} a_{l,0}\sin(\xi_{l,0}+\delta_l).$$

Evaluation of equation (24) at $\theta_m=270°$ and $\theta_n=90°$ yields:

$$\bar{q}_{270}-\bar{q}_{90}=a_{270}^2-a_{90}^2+[2A_c(a_{270}\sin\xi_{270}+a_{90}\sin\xi_{90})-2A_s(a_{270}\cos\xi_{270}+a_{90}\cos\xi_{90})]\cos\delta_k+[2A_c(a_{270}\cos\xi_{270}+a_{90}\cos\xi_{90})+2A_s(a_{270}\sin\xi_{270}+a_{90}\sin\xi_{90})]\sin\delta_k \quad (25)$$

and similarly for $\theta_m=0°$ and $\theta_n=180°$ $$\bar{q}_0-\bar{q}_{180}=a_0^2-a_{180}^2+[2A_c(a_0\cos\xi_0+a_{180}\cos\xi_{180})+2A_s(a_0\sin\xi_0+a_{180}\sin\xi_{180})]\cos\delta_k-[2A_c(a_0\sin\xi_0+a_{180}\sin\xi_{180})-2A_s(a_0\cos\xi_0+a_{180}\cos\xi_{180})]\sin\delta_k. \quad (26)$$

The subscript k indicating the element has been omitted on the amplitude and phase variations and on the power measurements $\bar{q}$ for simplicity in (25) and (26) because this dependence is understood. These expressions may be written:

$$(\bar{q}_{270}-a_{270}^2)-(\bar{q}_{90}-a_{90}^2)=C_{11}\cos\delta_k+C_{12}\sin\delta_k$$
$$(\bar{q}_0-a_0^2)-(\bar{q}_{180}-a_{180}^2)=C_{21}\cos\delta_k+C_{22}\sin\delta_k \quad (27)$$

with $$C_{11}=2A_c(a_{270}\sin\xi_{270}+a_{90}\sin\xi_{90})-2A_s(a_{270}\cos\xi_{270}+a_{90}\cos\xi_{90}),$$
$$C_{12}=2A_c(a_{270}\cos\xi_{270}+a_{90}\cos\xi_{90})+2A_s(a_{270}\sin\xi_{270}+a_{90}\sin\xi_{90}),$$
$$C_{21}=2A_c(a_0\cos\xi_0+a_{180}\cos\xi_{180})+2A_s(a_0\sin\xi_0+a_{180}\sin\xi_{180}),$$

and $$C_{22}=-2A_c(a_0\sin\xi_0+a_{180}\sin\xi_{180})+2A_s(a_0\cos\xi_0+a_{180}\cos\xi_{180}).$$

The equations in (27) are easily solved for $\delta_k$ to obtain the estimate:

$$\delta_k=\tan^{-1}\left(\frac{C_{11}[(\bar{q}_0-a_0^2)-(\bar{q}_{180}-a_{180}^2)]-C_{21}[(\bar{q}_{270}-a_{270}^2)-(\bar{q}_{90}-a_{90}^2)]}{C_{22}[(\bar{q}_{270}-a_{270}^2)-(\bar{q}_{90}-a_{90}^2)]-C_{12}[(\bar{q}_0-a_0^2)-(\bar{q}_{180}-a_{180}^2)]}\right) \quad (28)$$

where the amplitudes $a_m$ and phase offsets $\xi_m$ are from measurements. Solution of the linear equations following (27) for the amplitude estimates gives:

$$\hat{a}_0=[C_{22}(A_c\cos\xi_{180}+A_s\sin\xi_{180})+C_{21}(A_c\sin\xi_{180}-A_s\cos\xi_{180})]/2[(A_c\cos\xi_0+A_s\sin\xi_0)(A_c\sin\xi_{180}-A_s\cos\xi_{180})-(A_c\sin\xi_0-A_s\cos\xi_0)(A_c\cos\xi_{180}+A_s\sin\xi_{180})], \quad (29)$$

$$\hat{a}_{180}=-[C_{22}(A_c\cos\xi_0+A_s\sin\xi_0)+C_{21}(A_c\sin\xi_0-A_s\cos\xi_0)]/2[(A_c\cos\xi_0+A_s\sin\xi_0)(A_c\sin\xi_{180}-A_s\cos\xi_{180})-(A_c\sin\xi_0-A_s\cos\xi_0)(A_c\cos\xi_{180}+A_s\sin\xi_{180})],$$

$$\hat{a}_{90}=[C_{11}(A_c\cos\xi_{270}+A_s\sin\xi_{270})+C_{12}(A_c\sin\xi_{270}-A_s\cos\xi_{270})]/2[(A_c\sin\xi_{90}-A_s\cos\xi_{90})(A_c\cos\xi_{270}+A_s\sin\xi_{270})-(A_c\cos\xi_{90}+A_s\sin\xi_{90})(A_c\sin\xi_{270}-A_s\cos\xi_{270})],$$

and $$\hat{a}_{270}=-[C_{11}(A_c\cos\xi_{90}+A_s\sin\xi_{90})-C_{12}(A_c\sin\xi_{90}-A_s\cos\xi_{90})]/2[(A_c\sin\xi_{90}-A_s\cos\xi_{90})(A_c\cos\xi_{270}+A_s\sin\xi_{270})-(A_c\cos\xi_{90}+A_s\sin\xi_{90})(A_c\sin\xi_{270}-A_s\cos\xi_{270})].$$

It must be emphasized that the estimators (28) and (29) for the phase and amplitude variations are not closed form expressions because the coefficients $C_{11}$, $C_{12}$, $C_{21}$, $C_{22}$, $A_c$, and $A_s$ depend on these variations. Hence, the estimates must be solved by an iterative procedure which is described below. Further, observe that because there are array antenna signal power measurements $\bar{q}$ at four phase settings for each element, there are 4M data measurements. Because the estimators $\hat{\delta}_k$ and $\hat{a}_{km}$ constitute a set of 5M variables, the estimator equations given by (28) and (29) are dependent. This problem is circumvented by use of equations (20) for initial amplitude estimates. Equation (19) can be used for initial phase error estimates with equations (27) and (28) used for iteration of the phase error.

To corroborate the results in (27) through (29), these generalizations should reduce to the previous expressions (19) and (20) under assumptions of small or negligible errors. Simplification of the expression in (24) as in the previous section obtains:

$$\bar{q}_m-\bar{q}_n\approx a_{km}^2-a_{kn}^2+2A_c[a_{km}\cos(\theta_m+\xi_m)\cos\delta_k-a_{km}\sin(\theta_m+\xi_m)\sin\delta_k-a_{kn}\cos(\theta_n+\xi_n)\cos\delta_k+a_{kn}\sin(\theta_n+\xi_n)\sin\delta_k] \quad (30)$$

with the assumption that $A_s\approx 0$. Writing the amplitude variations with phase as $a_{km}-a_{kn}=\epsilon_{mn}$, noting $\theta_n=\theta_m+\pi$, and ignoring terms higher than first order, i.e., $\epsilon^2$, $\epsilon\cos\xi$, $\epsilon\sin\xi$, etc., obtains:

$$\bar{q}_m - \bar{q}_n \cong 2a_k\epsilon_{mn} + 2a_kA_c[\cos\delta_k\{\cos(\theta_m + \xi_m) - \cos(\theta_n + \xi_n)\} - \sin\delta_k\{\sin(\theta_m + \xi_m) - \sin(\theta_n + \xi_n)\}] = 2a_k\{\epsilon_{mn} + A_c[\cos\delta_k\{\cos(\theta + \xi_m) + \cos(\theta + \xi_m)\} - \sin\delta_k\{\sin(\theta + \xi_m) + \sin(\theta + \xi_n)\}]\}. \quad (31)$$

For $\theta=\theta_0=0$ or $\theta=\theta_{\pi/2}=\pi/2$, the analogous results to (17) and (18) are:

$$\bar{q}_{270}-\bar{q}_{90}\approx 2a_k[2A_c\sin(\xi+\delta_k)-\epsilon] \quad (32)$$

$$\bar{q}_0-\bar{q}_{180}\approx 2a_k[\epsilon+2A_c\cos(\xi+\delta_k)] \quad (33)$$

with $\xi\approx\xi_m\approx\xi_n$ the nominal phase, $a_k$ the nominal amplitude, and $\sin\xi_m\approx 0$ and $\sin\xi_n\approx 0$. This simplification is tantamount to assuming that the imperfections for each element are uniform over the various phase settings. With this assumption, the estimators from (27) and (28) reduce to:

$$\hat{\delta}_k = \tan^{-1}\left[\left(\frac{\bar{q}_{270} - \bar{q}_{90} + 2a_k\epsilon_{270}}{\bar{q}_0 - \bar{q}_{180} - 2a_k\epsilon_0}\right]\right) - \xi \quad (34)$$

and $$\hat{a}_k = \frac{\sqrt{(\bar{q}_{270} - \bar{q}_{90} + 2a_k\epsilon_{270})^2 + (\bar{q}_0 - \bar{q}_{180} - 2a_k\epsilon_0)^2}}{4A_c} \quad (35)$$

These results (34) and (35), which include imperfections in phase and amplitude control, are easily observed to reduce to the results for exact control given in (19) and (20) when there are no errors, i.e., $\epsilon=0$ and $\xi=0$.

Using a power measurement system such as that depicted in FIG. 4, measurements of received power $\bar{q}_{km}$ as described by (9) are performed for each phase setting $\theta_m=m\pi/2$, m=0,1,2,3 of each element k=1, 2, . . . , M. This data is used to solve estimates of the phase error $\hat{\delta}_k$ and the amplitude error $\hat{a}_k$ for each element. Because the equations (28) and (29) for these parameters are not in closed forms and readily soluble, an iterative procedure is applied. This procedure is as follows:

(1) Using the power measurements $\bar{q}_{km}$ for each element and the expression (19), compute initial phase error estimates:

$$\hat{\delta}_k^{(0)} = \tan^{-1}\left(\frac{\bar{q}_{k,270} - \bar{q}_{k,90}}{\bar{q}_{k,0} - \bar{q}_{k,180}}\right);$$

(2) For each element use known values for the phase offsets $\xi_{km}$ and ideal values $\hat{a}_k=1$ for the initial amplitude estimates to generate initial values for the signal sums for each element from the expressions following (24):

$$A_{c,k}^{(0)} = \sum_{\substack{l=1\\ l\neq k}}^{M} \hat{a}_l\cos(\xi_{l,0} + \hat{\delta}_l^{(0)})$$

and $$A_{s,k}^{(0)} = \sum_{\substack{l=1\\ l\neq k}}^{M} \hat{a}_l\sin(\xi_{l,0} + \hat{\delta}_l^{(0)});$$

(3) Compute amplitude estimates using expression (20):

$$\hat{a}_k = \frac{\sqrt{(\bar{q}_{k,270} - \bar{q}_{k,90})^2 + (\bar{q}_{k,0} - \bar{q}_{k,180})^2}}{4A_{c,k}^{(0)}};$$

(4) For each element generate the next values of the signal sums:

$$A_{c,k}^{(i+1)} = \sum_{\substack{l=1\\ l\neq k}}^{M} \hat{a}_l\cos(\xi_{l,0} + \hat{\delta}_l^{(i)})$$

and $$A_{s,k}^{(i+1)} = \sum_{\substack{l=1\\ l\neq k}}^{M} \hat{a}_l\sin(\xi_{l,0} + \hat{\delta}_l^{(i)});$$

(5) Compute values for the coefficients from (27) using the phase offsets $\xi_{km}$ and the last amplitude sums $A_{c,k}^{(i)}$ and $A_{s,k}^{(i)}$ from step (4) with the amplitudes set to the estimate $\hat{a}_k$:

$$C_{k,11}^{(i)}=2\hat{a}_k[a_{c,k}^{(i)}(\sin\xi_{k,270}+\sin\xi_{k,90})-A_{s,k}^{(i)}(\cos\xi_{k,270}+\cos\xi_{k,90})],$$

$$C_{k,12}^{(i)}=2\hat{a}_k[A_{c,k}^{(i)}(\cos\xi_{k,270}+\cos\xi_{k,90})+A_{s,k}^{(i)}(\sin\xi_{k,270}+\sin\xi_{k,90})],$$

$$C_{k,21}^{(i)}=2\hat{a}_k[A_{c,k}^{(i)}(\cos\xi_{k,0}+\cos\xi_{k,180})+A_{s,k}^{i}(\sin\xi_{k,0}+\sin\xi_{k,180})],$$

and $$C_{k,22}^{(i)}=2\hat{a}_k[-A_{c,k}^{(i)}(\sin\xi_{k,0}+\sin\xi_{k,180})+A_{s,k}^{(i)}(\cos\xi_{k,0}+\cos\xi_{k,180})].$$

(6) For each element compute the next estimates of the phase errors from (28) with the amplitudes set to the estimate $\hat{a}_k$:

$$\hat{\delta}_k^{(i)}=\tan^{-1}(\{C_{k,11}^{(i)}[\bar{q}_{k,0}-\bar{q}_{k,180}]-C_{k,21}^{(i)}[\bar{q}_{k,270}-\bar{q}_{k,90}]\}/\{C_{k,22}^{(i)}[\bar{q}_{k,270}-q_{k,90}]-C_{k,12}^{(i)}[\bar{q}_{k,0}-\bar{q}_{k,180}]\}).$$

(7) If the updated estimates $\hat{\delta}_k^{(i)}$ are not within convergence limits of the previous estimates $\hat{\delta}_k^{(i-1)}$, then continue the iteration from step (4); otherwise terminate with the given values. This procedure should converge since the derivative of the arctangent is less than unity. Moreover, the process should converge readily because the array and electronics are expected to have small variation. However, caution is advised since computational accuracy can affect convergence.

FIGS. 6(*a–d*) show the rate of convergence for various values of signal-to-noise ratio and number of samples. Observe that the convergence of the procedure displays reasonable performance.

The phase error $\hat{\delta}_k$ and the amplitude error $\hat{a}_k$ for each element from (34) and (35) contain not only the errors attributable to the electronics, but also any errors induced by attitude control or pointing of the antenna platform. Examination of the array factor of the antenna:

$$f(\theta,\phi)=\sum_{m,n} S_{mn}e^{jk\hat{r}\cdot d_{mn}}=\sum_{m=0}^{M-1}\sum_{n=0}^{N-1}\alpha_{mn}e^{jk(\hat{r}-\hat{r}_0)\cdot d_{mn}}=\sum_{m=0}^{M-1}\sum_{n=0}^{N-1}\alpha_{mn}e^{jk(d_{x,m}\gamma+d_{y,n}\chi)} \quad (36)$$

with $\gamma=\sin\theta\cos\iota-\sin\theta_0\cos\iota_0$ and $\chi=\sin\theta\sin\iota-\sin\theta_0\sin\iota_0$ reveals that any phase error that affects the phases of all elements equally does not affect the directivity of the array antenna. In addition, random errors with correlation times greater than the time for calibration and systematic errors that are invariant over the calibration period are inconsequential. However, systematic and random pointing errors of sufficiently short duration to affect calibration must be addressed if they affect individual elements differently. To the extent that the systematic errors or the means of random errors can be determined, these must be deducted from the measured errors $\hat{\delta}_k$ and $\hat{a}_k$ to give corrected estimates $\delta_k$ and $\tilde{a}_k$. Any residual pointing errors that cannot be estimated must be resolved by iteration of the calibration procedure.

For a given calibration measurement, the beam of the array antenna is pointed using the previously determined corrections $C_\delta$ for the phase and $C_a$ for the amplitude. Given the corrected estimates $\delta_k$ and $\tilde{a}_k$ of the phase and amplitude errors, a phase correction $C_\delta'$ and an amplitude correction $C_a'$ may be computed recursively from the previous corrections by:

$$C_\delta'=C_\delta-\mu_\delta\delta_k \quad (37)$$

and $$C_a'=C_a-\mu_a\alpha_k \quad (38)$$

Figure 7:
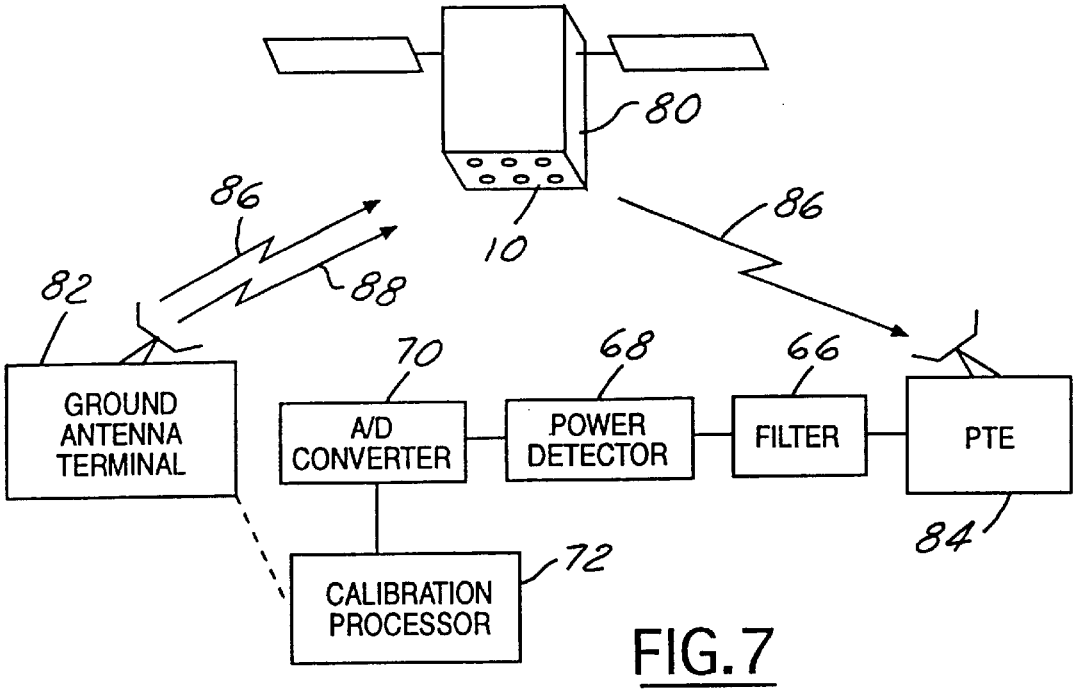
FIG. 7 is a block diagram illustrating array antenna system connections for transmit calibration with a satellite based array.
Figure 8:
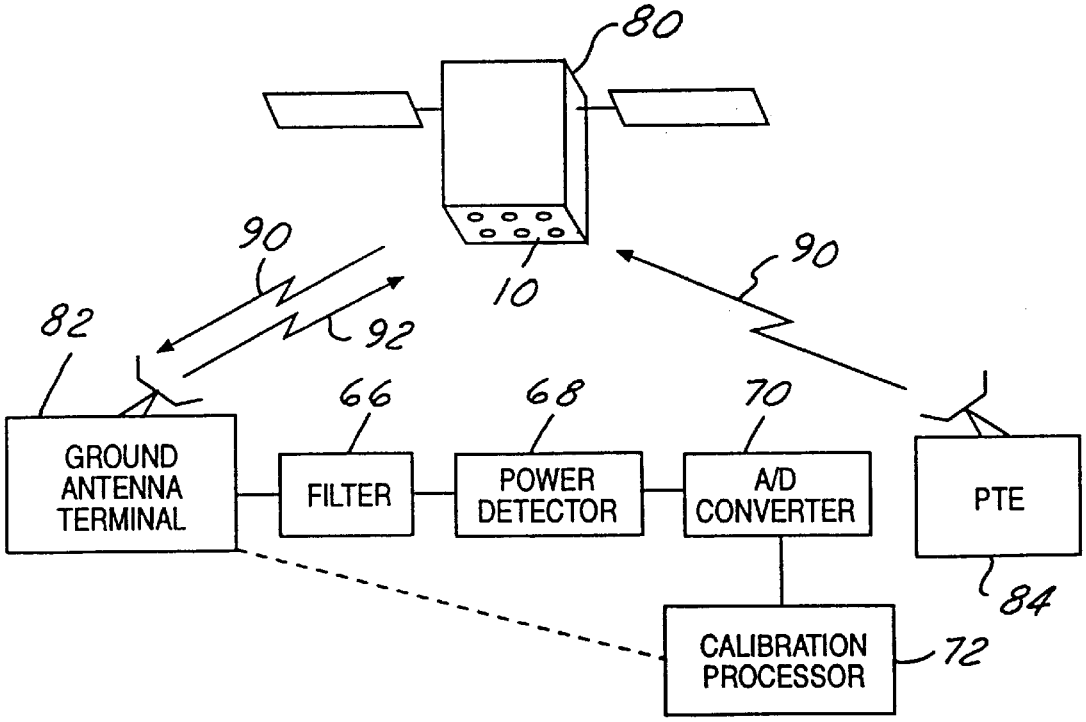
FIG. 8 is a block diagram illustrating array antenna system connections for receive calibration with a satellite based array.

Referring now to FIGS. 7 and 8, the calibration method of the present invention is simple as indicated by an example involving an array antenna 10 on a communication satellite 80. Calibration may be invoked as a diagnostic measure either in response to reduced or anomalous performance or as a periodic component of satellite operations. FIG. 7 shows system connections for transmit (forward link) calibration. The following summarizes the basic sequence of operations for transmit calibration.

First, a ground antenna terminal 82 prepares for calibration by taking a forward beam from user service, pointing it at a performance test equipment (PTE) terminal 84 on earth, and transmitting a calibration signal 86 via the forward link. The calibration signal is a sinusoid described previously.

Second, PTE terminal 84 is prepared for calibration by pointing its emulated user receive (return) beam at satellite 80. The channel automatic gain controller (AGC) is set to a fixed value (disabled).

Next, calibration processor 72 sends a calibrate command 88 via ground antenna terminal 82 to array antenna 10. Upon receipt of calibrate command 88, ASICs of array antenna 10 sequence the phases of each of antenna elements 12 through the four orthogonal phase states. When calibration processor 72 detects a calibration synchronization pulse at the start of the calibration sequence, the calibration processor begins sampling the detected calibration signal 86 from satellite 80 and records the samples.

Preferably, the calibration synchronization pulse is generated by switching the phase of every odd-numbered antenna element by 180° to produce a calibration signal null. The null is followed by a dwell time during which all antenna elements remain in their 0° reference phase state.

The individual antenna element phase sequencing starts with sequencing the phase of an individual antenna element signal from the 0° reference phase state to the 180° phase state. The 180° phase state is held for a synchronization time to mark the beginning of the antenna element transmission, and to provide unambiguous synchronization and power measurement $P_{180}$ of calibration signal 86. This is followed by toggling the phase of the antenna element by 90°, 270°, and 0° between states $\phi_{90}$, $\phi_{270}$, and $\phi_0$ with corresponding power measurements $P_{90}$, $P_{270}$, and $P_0$ of calibration signal 86 being performed.

Calibration processor 72 subsequently processes the recorded samples to estimate the phase and amplitude errors of the antenna element signals using equations (34) and (35). These values are corrected for pointing errors and are stored for possible use in adjusting the phase and amplitude correction coefficients (37) and (38) of the array elements. This calibration procedure is repeated until the phase and amplitude errors converge within acceptable limits.

FIG. 8 shows the system connections for receive (return link) calibration. The following summarizes the basic sequence of operations for receive calibration. First, ground antenna terminal 82 prepares for calibration by taking one beam from user service and pointing it at PTE terminal 84 on earth. The channel AGC is set to a fixed value (disabled). Second, PTE terminal 84 is prepared for calibration by pointing its emulated user transmit (forward) beam at satellite 80 and transmits a calibration signal 90 via the forward link.

Next, calibration processor 72 sends a calibrate command 92 via ground terminal 82 to array antenna 10. Upon receipt of calibrate command 92, ASICs of array antenna 10 sequence the phases of each of antenna elements 12 through four orthogonal phase states. When calibration processor 72 detects a calibration synchronization pulse at the start of the calibration sequence, the calibration processor begins sampling the detected calibration signal 90 from satellite 80 and records the samples.

Calibration processor 72 subsequently processes the recorded samples to estimate the phase and amplitude errors of the antenna elements using equations (34) and (35). These values are corrected for pointing errors as described above and repeated until the errors converge within acceptable limits.

The orthogonal phase calibration method of the present invention has application to any area requiring phased array antenna technology. This includes any communication link, military or commercial, requiring rapid scanning of one or more high gain radio frequency beams. These applications depend on array antennas which require periodic calibration.

It should be noted that the present invention may be used in a wide variety of different constructions encompassing many alternatives, modifications, and variations which are apparent to those with ordinary skill in the art. Accordingly, the present invention is intended to embrace all such alternatives, modifications, and variations as fall within the spirit and scope of the appended claims.

What is claimed is:

1. A method of calibrating an array antenna element having a signal with a phase and an amplitude, the method comprising:

sequentially switching the phase of the antenna element signal through four orthogonal phase states;

measuring the power of the array antenna signal at each of the four orthogonal phase states;

determining a phase error for the antenna element signal as a function of the power of the array antenna signal at each of the four orthogonal phase states; and adjusting the phase of the antenna element signal by the phase error.

2. The method of claim 1 wherein:

the phase error for the antenna element signal is determined by the equation:

$$\hat{\delta}_k = \tan^{-1}\left[\left(\frac{\bar{q}_{270} - \bar{q}_{90}}{\bar{q}_0 - \bar{q}_{180}}\right]\right)$$

where, $\hat{\delta}_k$ is the phase error for the antenna element signal, and $\bar{q}_0$, $\bar{q}_{90}$, $\bar{q}_{180}$, and $\bar{q}_{270}$ is the power of the array antenna signal at each of the four orthogonal phase states.

3. The method of claim 1 wherein:

at least one updated phase error for the antenna element signal is determined and the phase of the antenna element signal is adjusted until the one updated phase error converges within an acceptable level.

4. The method of claim 1 further comprising:

determining an amplitude error for the antenna element signal as a function of the power of the array antenna signal at each of the four orthogonal phase states; and adjusting the amplitude of the antenna element signal by the amplitude error.

5. The method of claim 4 wherein:

the amplitude error for an antenna element signal is determined by the equation:

$$\hat{a}_k = \frac{\sqrt{(\bar{q}_{270} - \bar{q}_{90})^2 + (\bar{q}_0 - \bar{q}_{180})^2}}{4A_c}$$

where, $\hat{a}_k$ is the amplitude error for the antenna element signal, $\bar{q}_{270}$, $\bar{q}_{90}$, $\bar{q}_0$, and $\bar{q}_{180}$ is the power of the array antenna signal at each of the four orthogonal phase states, and $A_c$ is the power of all the other signals of the antenna elements of the array antenna produced by the phase errors of these signals.

6. The method of claim 4 wherein:

at least one updated amplitude error for the antenna element signal is determined and the amplitude of the antenna element signal is adjusted until the one updated amplitude error converges within an acceptable level.

7. A method for calibrating an array antenna provided with a plurality of antenna elements each having a signal with a phase and an amplitude forming an array antenna signal, the method comprising:

sequentially switching the phase of each antenna element signal one at a time through four orthogonal phase states;

measuring at each orthogonal phase state the power of the array antenna signal;

determining a phase error for each of the antenna element signals, wherein the phase error for an antenna element signal is a function of the power of the array antenna signal at each of the four orthogonal phase states; and adjusting the phase of each of the antenna element signals by the corresponding phase error.

8. The method of claim 7 wherein:

the phase error for an antenna element signal is determined by the equation:

$$\hat{\delta}_k = \tan^{-1}\left[\left(\frac{\bar{q}_{270} - \bar{q}_{90}}{\bar{q}_0 - \bar{q}_{180}}\right]\right)$$

where, $\hat{\delta}_k$ is the phase error for the antenna element signal, and $\bar{q}_0$, of $\bar{q}_{90}$, $\bar{q}_{180}$, and $\bar{q}_{270}$ is the power of the array antenna signal at each of the four orthogonal phase states.

9. The method of claim 7 wherein:

at least one updated phase error for the antenna element signal is determined and the phase of the antenna element signal is adjusted until the one updated phase error converges within an acceptable level.

10. The method of claim 7 further comprising:

determining an amplitude error for each of the antenna element signals, wherein the amplitude error for an antenna element signal is a function of the power of the array antenna signal at each of the four orthogonal phase states; and adjusting the amplitude of each of the antenna element signals by the corresponding amplitude error.

11. The method of claim 10 wherein:

the amplitude error for an antenna element signal is determined by the equation:

$$\hat{a}_k = \frac{\sqrt{(\bar{q}_{270} - \bar{q}_{90})^2 + (\bar{q}_0 - \bar{q}_{180})^2}}{4A_c}$$

where, $\hat{a}_k$ is the amplitude error for the antenna element signal, $\bar{q}_{270}$, $\bar{q}_{90}$, $\bar{q}_0$, and $\bar{q}_{180}$ is the power of the array antenna signal at each of the four orthogonal phase states, and $A_c$ is the power of all the other signals of the antenna elements of the array antenna produced by the phase errors of these signals.

12. The method of claim 10 wherein:

at least one updated amplitude error for the antenna element signal is determined and the amplitude of the antenna element signal is adjusted until the one updated amplitude error converges within an acceptable level.

13. An array antenna system comprising:

an array antenna provided with a plurality of antenna elements each having a signal with a phase and an amplitude forming an array antenna signal; and a calibration processor operable with the array antenna to sequentially switch the phase of each antenna element signal one at a time through four orthogonal phase states and measure at each orthogonal phase state the power of the array antenna signal, the calibration processor further operable to determine a phase error for each of the antenna element signals, wherein the phase error for an antenna element signal is a function of the power of the array antenna signal at each of the four orthogonal phase states, the calibration processor further operable to adjust the phase of each of the antenna element signals by the corresponding phase error.

14. The system of claim 13 wherein:

the calibration processor is further operable to determine an amplitude error for each of the antenna element signals, wherein the amplitude error for an antenna element signal is a function of the power of the array antenna signal at each of the four orthogonal phase states, the calibration processor is further operable to adjust the amplitude of each of the antenna element signals by the corresponding amplitude error.

15. The system of claim 13 further comprising:

a reference antenna operable with the array antenna for transmitting and receiving signals.

16. The system of claim 15 wherein:

the array antenna transmits an array antenna signal to the reference antenna and the calibration processor is operable with the reference antenna to measure the signal received by the reference antenna to determine the power of the array antenna signal transmitted by the array antenna at each orthogonal phase state.

17. The system of claim 15 wherein:

the reference antenna transmits a reference signal to the array antenna and the calibration processor is operable with the array antenna to measure the signal received by the array antenna to determine the power of the reference signal received by the array antenna at each orthogonal phase state.

18. The system of claim 13 wherein:

the calibration processor includes a power detector which measures the power of each antenna element signal.

19. The system of claim 18 wherein:

the power detector is a quadratic detector.

20. The system of claim 13 wherein:

the array antenna is positioned on a spacecraft.

* * * * *